US005883608A

United States Patent [19]

Hashimoto

[11] Patent Number: 5,883,608

[45] Date of Patent: Mar. 16, 1999

[54] INVERTED SIGNAL GENERATION CIRCUIT FOR DISPLAY DEVICE, AND DISPLAY APPARATUS USING THE SAME

[75] Inventor: Seiji Hashimoto, Yokohama, Japan

[73] Assignee: Canon Kabushiki Kaisha, Tokyo, Japan

[21] Appl. No.: 579,362

[22] Filed: Dec. 27, 1995

[30] Foreign Application Priority Data

Dec. 28, 1994 [JP] Japan ..... 6-337667

[51] Int. Cl.[6] ..... G09G 3/36

[52] U.S. Cl. ..... 345/96; 345/209

[58] Field of Search ..... 345/87, 94, 96, 345/79, 211, 209

[56] References Cited

U.S. PATENT DOCUMENTS 4,591,848 5/1986 Morozumi et al. ..... 345/94
4,910,597 3/1990 Harada et al. .
4,914,319 4/1990 Hashimoto .
4,922,138 5/1990 Hashimoto et al. .
5,058,994 10/1991 Mihara et al. .
5,648,793 7/1997 Chen ..... 345/96

FOREIGN PATENT DOCUMENTS 61-112187 5/1986 Japan .
4371997 12/1992 Japan .

*Primary Examiner*—Jeffery Brier
*Attorney, Agent, or Firm*—Fitzpatrick, Cella, Harper & Scinto

[57] ABSTRACT

A signal generation circuit for driving a display device, comprises capacitance unit having a first terminal serving as an input terminal of an information signal, and a second terminal, first switch unit for connecting the second terminal of the capacitance means to a first reference potential source, second switch for connecting the first terminal to a second reference potential source, first signal read-out unit for reading out a signal from the first terminal while the second terminal is connected to the first reference potential source, and second signal read-out unit for reading out a signal from the second terminal while the first terminal is connected to the second reference potential source.

9 Claims, 14 Drawing Sheets

φh11
φh12
φh13
φh14
R
G
B
SW0
a
b
ST1
ST2
ST3
ST4
ST5
ST6
ST7
ST8
VR
φCL1
φCL1'
φCL2
φCL2'
φT
φT'
100
110
D1
D2
D3
D4

INVERTED SIGNAL GENERATION CIRCUIT FOR DISPLAY DEVICE, AND DISPLAY APPARATUS USING THE SAME

BACKGROUND OF THE INVENTION

1. Field of the Invention

The present invention relates to a display apparatus used as a display of a personal computer, video camera recorder, digital camera, TV receiver, video projector, and the like, and a circuit for a display device.

2. Related Background Art

Various types of display apparatuses are available. For example, display apparatuses using display devices such as a plasma display, electrochromy display, liquid crystal display, DMD, and the like are known.

Of these apparatuses, a display apparatus using a liquid crystal display will be described below.

A conventional color liquid crystal display apparatus having the arrangement shown in FIG. 17 is known. Referring to FIG. 17, the apparatus comprises a display pixel unit 10, a vertical scanning circuit 20 for the display pixel unit, a sampling switch 30 of an input image signal, a horizontal scanning circuit 40 for the sampling circuit, a line memory 100 for temporarily storing an image signal, and an analog buffer 110 for current-amplifying a signal read out from the line memory.

Each of display pixels on the display pixel unit 10 comprises a switching transistor 11, a liquid crystal 12, and a pixel capacitor 13, as shown in FIG. 18. The gate of the switching transistor 11 is connected to the vertical scanning circuit 20 via a gate line 14, and the input terminal of the switching transistor 11 is connected to the analog buffer 110 via a vertical data line 15. The other terminal of the pixel capacitor 13 is connected to a common electrode line 16, and is applied with a common electrode voltage $V_{LC}$.

The sampling switch 30 receives color signals (red, blue, and green) from a signal processing circuit 50 at its input terminal. The signal processing circuit 50 performs correction processing (gamma processing) taking the relationship between the applied voltage and the transmittance (liquid crystal characteristics) into consideration, inverted signal processing for prolonging the service life of a liquid crystal, and the like. A control circuit 60 drives the display apparatus at a predetermined timing.

FIG. 19 shows the arrangement of an inverted signal generation circuit conventionally arranged in the signal processing circuit 50 shown in FIG. 17. FIG. 20 is an output waveform chart of the inverted signal generation circuit shown in FIG. 19. Signal inversion processing in the display apparatus shown in FIG. 17 will be explained below with reference to FIGS. 18 to 20. Referring to FIG. 19, the amplitude of a video signal $U_1$ is normally about 1 V, and this signal is converted into an inverted signal $U_4$ whose amplitude ($V_H$–$V_L$) is about 10 V, as shown in FIG. 20, so as to drive a liquid crystal. Referring to FIG. 18, the common electrode 16 ($V_{LC}$) of the liquid crystal 12 is connected to a common electrode 17 ($V_{COM}$) of the pixel capacitor 13, and its common electrode potential $V_{LCCOM}$ is roughly a middle potential of the inverted signal $U_4$. In the inverted signal generation circuit shown in FIG. 19, the input video signal $U_1$ is amplified by an amplifier 51 to positive and negative polarity signals $U_2$ and $U_3$ each of which has an amplitude of about 5 V, and these signals are input to level shift circuits 52 and 53. The inverted signal $U_4$ is generated by alternately switching the output signals of the level shift circuits 52 and 53 in response to control pulses.

A display apparatus in which color filters R, G, and B are arranged on each pixel is known. In order to drive this display apparatus in a non-interlace mode, two methods are available. One method is a double-speed driving method for driving an input video signal S as a doubled frequency signal to write signals in two pixel lines of the display pixel unit, and the other method is a two-system input method having two signal input systems for the display pixel unit.

The above-mentioned inverted signal generation method requires a signal voltage of ten-odd V. The power supply voltage of a normal IC is 5 V. The technical trend is to lower the power supply voltage, and to drive an IC by, e.g., 3.3 V. However, in an existing display apparatus, since a liquid crystal with a high load capacitance is driven by a high-voltage, high-frequency signal, a driving IC is manufactured using an IC having a high withstand voltage and a large p-n junction area. As a result, the IC chip size increases, resulting in high cost and large consumption power. Such an IC cannot be easily applied to the double-speed driving method and a multi-pixel display apparatus with a large number of terminals.

Furthermore, in the case of the two-system input method, the signal level difference between the two systems causes noise such as vertical or horizontal stripes and line flicker. More specifically, in this method, signals are written in two pixel lines using two system inputs. In this case, the level difference between the two pixel lines causes deterioration of image quality in correspondence with the period of an inverted signal. Upon polarity inversion in units of pixel lines, the brightness varies in units of pixel lines, and this variation appears as noise such as vertical or horizontal stripes. In particular, when color pixels have a delta layout, human eyes recognize the level difference between pixels, which are adjacent in the horizontal direction, as a vertical stripe. When the signal polarity is inverted every two pixel lines, the level differences conspicuously appear in units of two lines in turn. In this case, especially, line flicker stands out. This phenomenon is closely associated with the vertical motion of an input image. When the motion of an image becomes close to the field period, the above-mentioned phenomenon becomes conspicuous. According to the experimental results of the present inventors, it is found that the image quality begins to deteriorate when the level difference reaches several ten mV.

It is very difficult to adjust the signal level of several ten mV or less with respect to the signal amplitude of ten-odd V. In consideration of the used temperature conditions and aging, it is conventionally reckoned that such noise cannot be eliminated.

As one of conventional methods, a method of reducing an offset voltage of a buffer circuit at the output side of a memory has been described in Japanese Laid-Open Patent Application No. 4-371997. However, this method changes a voltage at the other terminal of memory means to reduce the offset voltage of the buffer circuit, but does not aim at reducing the amplitude of an input signal to the memory.

SUMMARY OF THE INVENTION

It is the first object of the present invention to provide an inverted signal generation circuit which can solve the above-mentioned technical problems by improving the circuit structure, and a display apparatus using the same.

It is the second object of the present invention to provide an inverted signal generation circuit which can generate an inverted signal at a low voltage, and a display apparatus using the same.

It is the third object of the present invention to provide an inverted signal generation circuit which can improve the quality of a displayed image when it is used in a display apparatus, and a display apparatus using the same.

It is the fourth object of the present invention to provide an inverted signal generation circuit which can be manufactured on a substrate common to a display device and is suitable for a size reduction of an apparatus and a cost reduction of peripheral circuits, and a display apparatus using the same.

In order to achieve the above objects of the present invention, there is provided a signal generation circuit for driving a display device, comprising capacitance means having a first terminal serving as an input terminal of an information signal, and a second terminal, first switch means for connecting the second terminal of the capacitance means to a first reference potential source, second switch means for connecting the first terminal to a second reference potential source, first signal read-out means for reading out a signal from the first terminal while the second terminal is connected to the first reference potential source, and second signal read-out means for reading out a signal from the second terminal while the first terminal is connected to the second reference potential source.

DETAILED DESCRIPTION OF THE PREFERRED EMBODIMENTS

Figure 1:
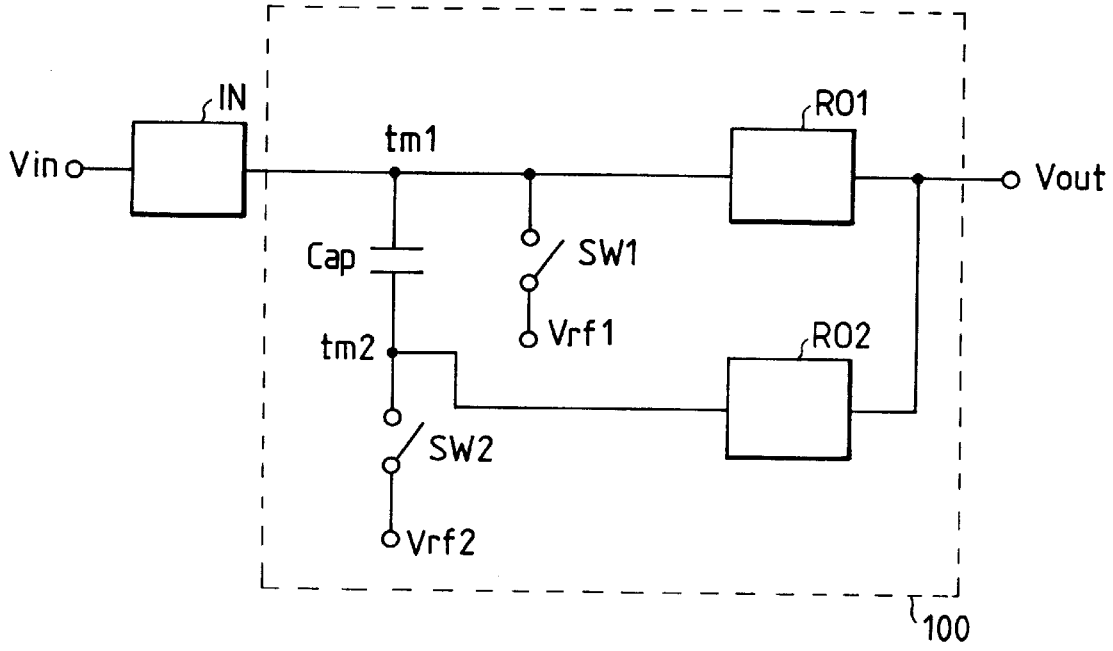
FIG. 1 is a circuit diagram showing the arrangement of an inverted signal generation circuit according to a preferred aspect of the present invention.

FIG. 1 shows an inverted signal generation circuit 100 according to a preferred aspect of the present invention.

The inverted signal generation circuit 100 comprises capacitance means Cap, a first switch SW1 for connecting a first terminal tm1 of the capacitance means Cap to a first reference potential source Vrf1, and a switch SW2 for connecting a second terminal tm2 to a second reference potential source Vrf2.

Furthermore, the circuit 100 comprises first and second read-out means RO1 and RO2.

The first read-out means RO1 reads out a signal held in the capacitance means Cap via the terminal tm1 when the first switch SW1 is OFF. The second read-out means RO2 reads out a signal held in the capacitance means Cap via the terminal tm2. The first switch SW1 is turned on when a read-out operation is performed from the terminal tm2, and the second switch SW2 is turned on when a read-out operation is performed from the terminal tm1.

Means IN outputs an information signal input from an input terminal Vin to the terminal tm1, and serves as signal input means when viewed from the capacitance means Cap.

The capacitance means Cap is one called a condenser or capacitor, and preferably comprises an MIM arrangement in which an insulating layer (dielectric layer) is sandwiched between conductive layers, an MIS arrangement in which an insulating layer (dielectric layer) is sandwiched between conductive and semiconductor layers, a p-n junction capacitance of a semiconductor, or the like.

The first and second switches SW1 and SW2 are turned on/off in response to input pulse signals, and consist of insulating gate type transistors, bipolar transistors, or the like.

The reference potential sources Vrf1 and Vrf2 comprise power supply voltage lines or ground lines, or constant voltage lines obtained by changing the potential levels of the former lines. Thus, these sources can reset or clamp the two terminals of the capacitance means Cap to predetermined potentials.

The read-out means RO1 and RO2 may simply comprise various types of gates for transferring signals, and more specifically, comprise transistor gates, CMOS gates, or the like.

The signal input means IN can similarly comprise various types of gates.

The operation timings of the switches SW1 and SW2 and the respective means IN, RO1, and RO2 are controlled by pulse signals from a pulse supply circuit (not shown). The output timings of the pulse signals from the pulse supply circuit may be determined in advance in circuit design, or may be appropriately set by a controller such as a microcomputer.

The operation of the circuit shown in FIG. 1 will be described below.

In a state wherein the terminal tm2 is connected to the reference potential source Vrf2, the means IN holds an input signal at the terminal tm1 of the capacitance means Cap. If the means RO1 reads out this signal to an output terminal Vout in this state, the input signal is output as a non-inverted signal.

However, assume that the terminal tm2 is disconnected from the reference potential source Vrf2 by the switch SW2, i.e., is set in a floating state, and thereafter, the switch SW1 is turned on to connect the terminal tm1 to the reference potential source Vrf1. In this state, if the means RO2 reads out the signal, an inverted signal is read out from the terminal tm2, and is output to the output terminal Vout.

The reference level of the readout non-inverted or inverted information signal depends on the potential levels of the reference potential sources Vrf1 and Vrf2.

The period of the inversion operation is appropriately determined in correspondence with the characteristics of a display device to be used or the required image quality of a displayed image. The period of the inversion operation includes a 1-field (1-frame) inversion period that performs inversion each time a scan of all scan lines (rows) on the frame is completed in interlace or non-interlace scanning, a 1-field inversion period that performs inversion each time one vertical scan in interlace scanning is completed, a 1H inversion period that performs inversion each time a scan of one scan line (row) is completed, a 1-dot inversion period that performs inversion each time selection of one pixel is completed, and the like. In any case, the inversion operation is performed at a predetermined period.

The operation timing of the inversion operation can be easily determined in such a manner that a horizontal synchronization signal included in a video signal is detected, and the respective switches and signal read-out means are turned on/off in synchronism with the horizontal synchronization signal.

Figure 2:
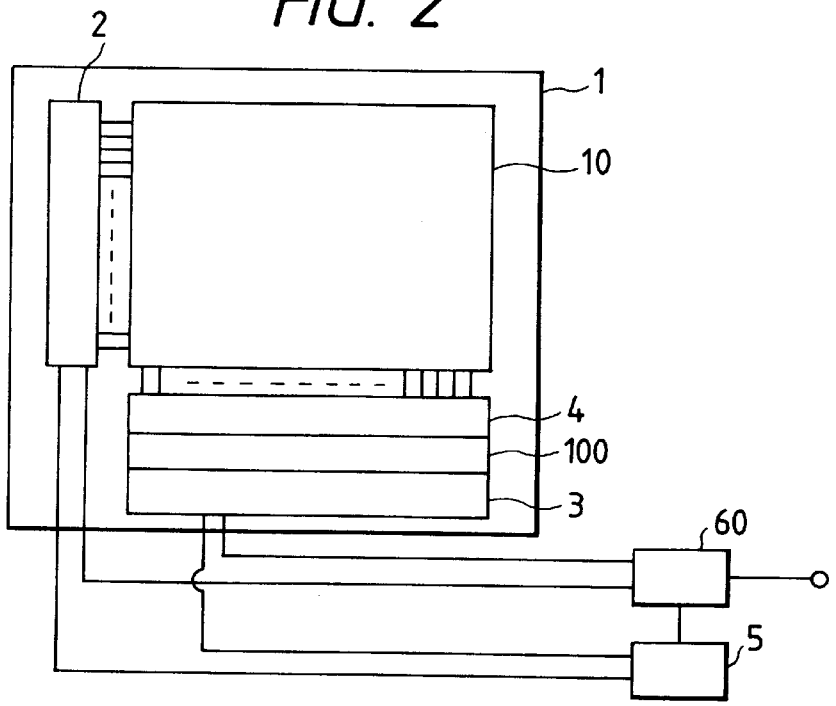
FIG. 2 is a schematic view showing the arrangement of a display apparatus according to a preferred aspect of the present invention.

FIG. 2 is a schematic view showing a display apparatus according to a preferred aspect of the present invention.

The display apparatus comprises a substrate 1 constituting a display device, a display pixel unit 10, a scanning circuit 2 which is arranged as needed, a sampling switch 3, a line memory 100 having the above-mentioned inverted signal generation circuit, and a buffer amplifier 4 which is arranged as needed.

The respective circuits 2, 3, 4, and 100 on the substrate 1 receive various timing signals from a control circuit 60 and color information signals of, e.g., red (R), blue (B), and green (R), or a monochrome information signal.

A power supply circuit 5 supplies a power supply voltage and a reference potential to the circuits 2, 3, 4, 100, and 60.

The substrate 1 preferably comprises a transparent substrate such as a glass substrate, quartz substrate, plastic substrate, or the like, or a semiconductor substrate such as a silicon substrate, gallium arsenide substrate, or the like.

The display pixel unit 10 on the substrate 1 is formed with an information signal electrode if the substrate has a simple matrix. On the other hand, a scanning signal electrode is arranged on the substrate side opposing the information signal electrode.

If an active matrix substrate is used, a transistor array is arranged on the display pixel unit. Each transistor preferably comprises a thin-film transistor using amorphous silicon, polycrystalline silicon, monocrystalline silicon, or the like.

Similarly, the circuits 2, 3, 4, and 100 on the substrate 1 are manufactured using various types of thin-film transistors described above. In particular, a transistor having an LDD (Lightly Doped Drain) structure, which has a high withstand voltage and in which the drain region has two regions, i.e., high- and low-impurity concentration regions, is preferably used.

In the case of, e.g., a 3" display device, a monocrystalline silicon substrate is used as the substrate, transistors in the pixel unit 10 are manufactured by p- or n-channel thin-film transistors using poly-Si, and transistors of the circuits 2, 3, 4, and 100 are manufactured by p- or n-channel transistors using monocrystalline silicon, thus providing a high-performance display apparatus which can generate an inverted signal at high speed.

In the case of the DMD in which a micro mirror is arranged in each pixel of the pixel unit, the respective circuits are preferably formed using a monocrystalline silicon substrate and monocrystalline silicon transistors.

As the pixel layout of the display pixel unit used in the present invention, a stripe layout having R, G, and B stripe filters or a mosaic layout having R, G, and B mosaic filters are preferably used.

In particular, a delta layout in which R, G, and B filters are disposed while being offset from each other at half the pitch is more preferable since the resolution can be increased using a smaller number of pixels.

The present invention will be described below with reference to its embodiments.

First Embodiment

Figure 3:
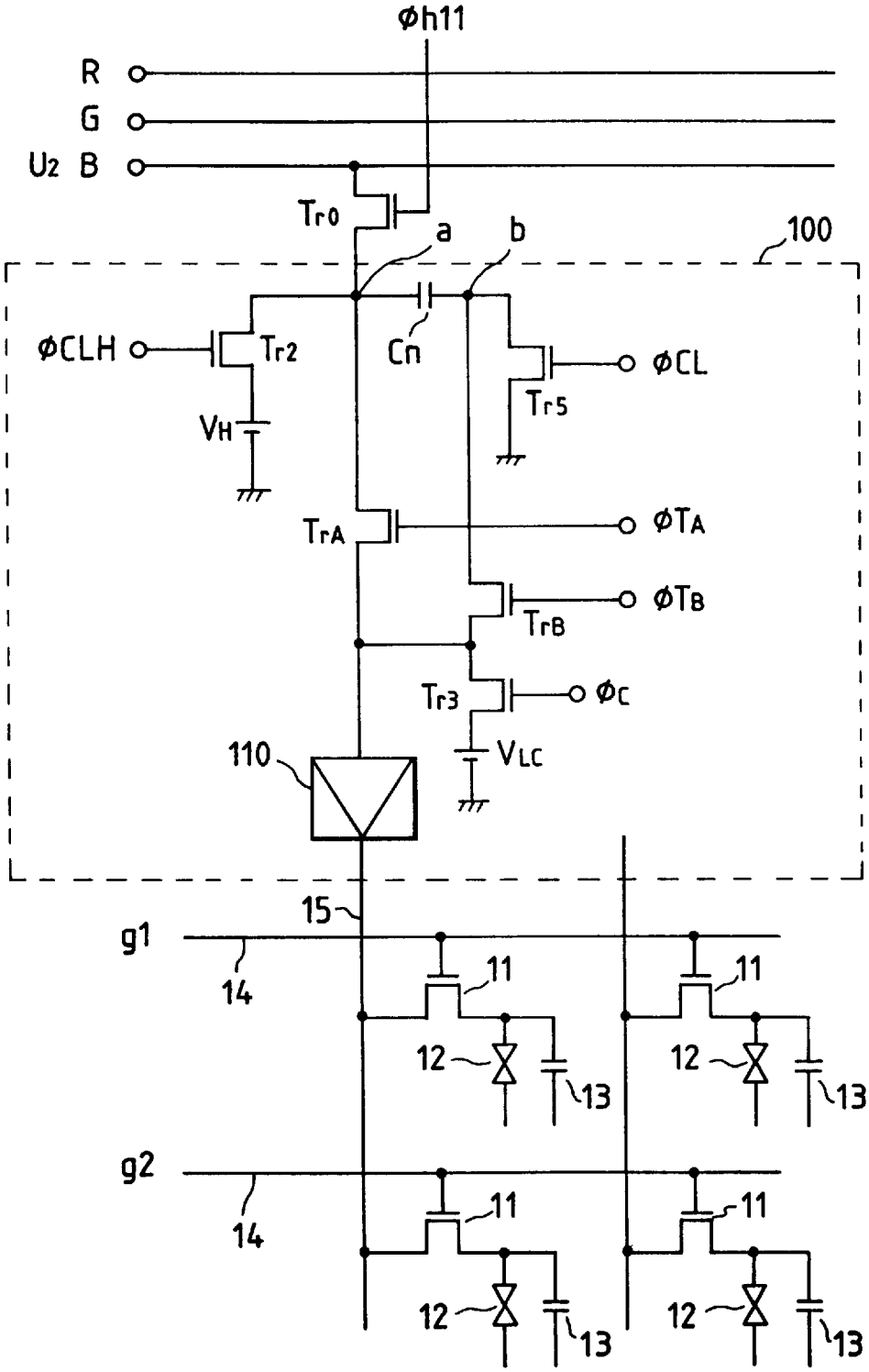
FIG. 3 is a circuit diagram of an inverted signal generation circuit according to the first embodiment of the present invention.

FIG. 3 shows the arrangement of an inverted signal generation circuit according to the first embodiment of the present invention. In this embodiment, an inverted signal is generated every horizontal scanning period (1H). The arrangement in a block 100 is the circuit arrangement as the characteristic feature of this embodiment.

Referring to FIG. 3, sampling switches $Tr_0$ each for fetching pixel information by sampling a video signal is connected to blocks 100. Each block 100 comprises capacitance means Cn for temporarily storing pixel information, a reset transistor $Tr_5$ for connecting a terminal b of the capacitance means Cn to ground, and a transfer transistor $Tr_A$ for transferring a voltage signal (positive polarity signal) at a terminal a of the capacitance means Cn to a buffer amplifier 110. The block 100 also comprises a reset transistor $Tr_2$ for resetting (clamping) the terminal a of the capacitance means Cn to a potential $V_H$, a transfer transistor $Tr_B$ for transferring a voltage signal (reverse polarity signal) at the terminal b of the capacitance means Cn to the buffer amplifier 110, and a reset transistor $Tr_3$ for resetting the input of the buffer amplifier 110 to a reference potential $V_{LC}$, and removing a residual signal. A signal output from the buffer amplifier 110 is written in a liquid crystal 12 of the corresponding pixel in a selected pixel line ($g_1$, $g_2$, . . . ) via a vertical data line 15.

Figure 4:
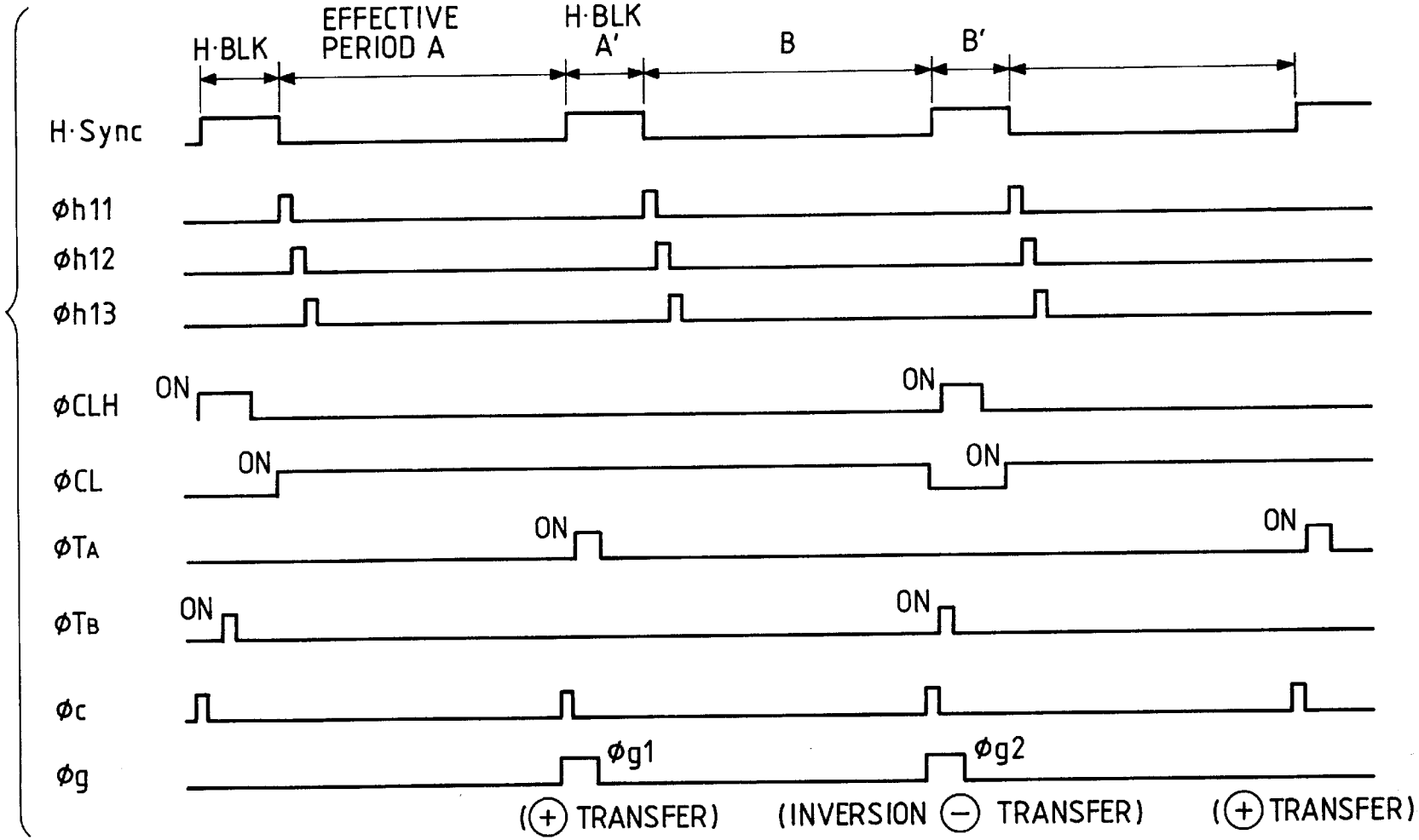
FIG. 4 is a timing chart of the respective signals in the circuit shown in FIG. 3.

FIG. 4 is a timing chart of the signals in the respective units in the inverted signal generation circuit shown in FIG. 3. The operation of the circuit shown in FIG. 3 will be explained below with reference to FIG. 4. The transistor $Tr_2$ is turned on in response to a pulse signal $\phi_{CLH}$ during a first 1H blanking period BLK, and the terminal a is reset to the potential $V_H$. During a 1H effective period, the reset transistor $Tr_2$ is disabled by the signal $\phi_{CLH}$, and the reset transistor $Tr_5$ is enabled by a signal $\phi_{CL}$. An input video signal $U_2$ (R, G, B) is a positive polarity signal of about 5 V (black potential $V_L$, white potential $V_L$+4.5 V). The sampling switches $Tr_0$ are sequentially turned on in response to bit pulses $\phi h_{11}$ to $\phi h_{en}$ from a horizontal scanning circuit 40, and the input video signal is sampled and held by the capacitance means Cn (period A).

During a horizontal blanking period A', the transistor $Tr_3$ is enabled by a pulse $\phi_C$, and the input of the buffer amplifier 110 is reset to the reference potential $V_{LC}$. The transistor $Tr_A$ is enabled by a pulse $\phi T_A$, and a signal at the terminal a of the capacitance means Cn is written in the respective pixels in a pixel line $g_1$ selected by a pulse $\phi_{g1}$ via the buffer amplifier 110.

Similarly, during the next effective period B, a video signal is sampled and held by the capacitance means Cn. During a blanking period B', the input of the buffer amplifier is reset to the reference potential $V_{LC}$ in response to a pulse $\phi_C$. On the other hand, the terminal b of the capacitance means Cn is set in a floating state since the transistor $Tr_5$ is disabled by a pulse $\phi_{CL}$. As a result, a signal $-U_2$ is induced at the terminal b as a reverse voltage of the terminal a.

When the transistor $Tr_2$ is enabled by a pulse $\phi_{CLH}$ to reset the terminal a of the capacitance means Cn to $V_H$, the voltage at the terminal b is subjected to a potential shift of $+V_H$, and consequently becomes $V_H-U_2$. More specifically, an inverted signal is generated. The inverted signal is written in the corresponding pixel in a pixel line $g_2$ via the transistor $Tr_B$ enabled by a pulse $\phi T_B$ and the buffer amplifier 110. In this manner, the input signal $U_2$ becomes an inverted signal which is inverted every 1H.

In the next field, a signal having a polarity opposite to that in the previous field is written in the respective pixels, and the DC component of a voltage to be applied to each liquid crystal becomes zero, thus preventing printing of the liquid crystals. As described above, since the circuit adopting this embodiment can operate at 5 V, an IC having this circuit can attain low consumption power and low cost. In addition, since the signal amplitude is small, the IC can drive a panel having a large number of pixels.

Figure 12:
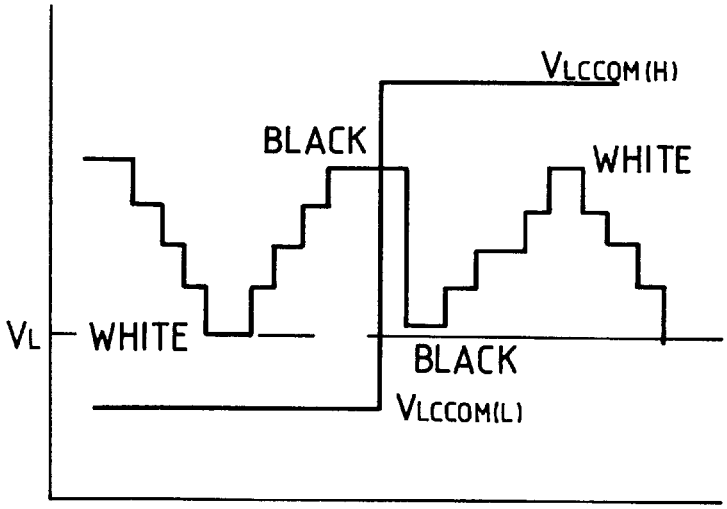
FIG. 12 is a waveform chart of the inverted signal and the common electrode potential in the circuit shown in FIG. 11.
Figure 19:
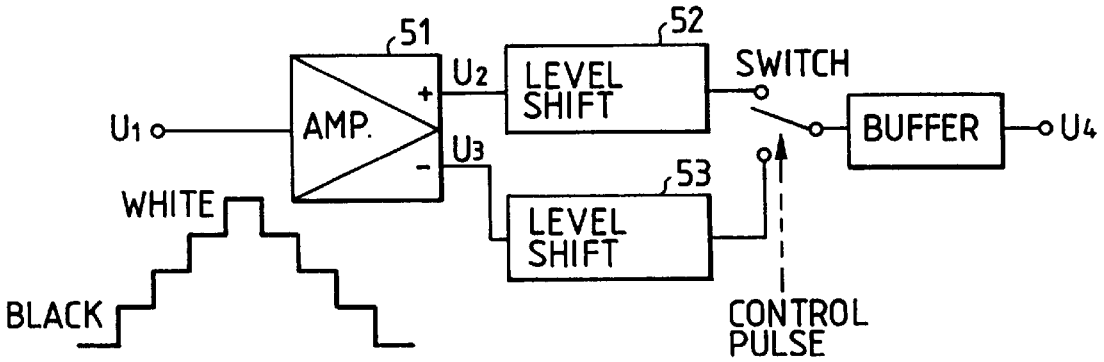
FIG. 19 PRIOR ART
FIG. 19 is a circuit diagram showing the arrangement of an inverted signal generation circuit arranged as a portion of a signal processing circuit shown in FIG. 17.
Figure 20:
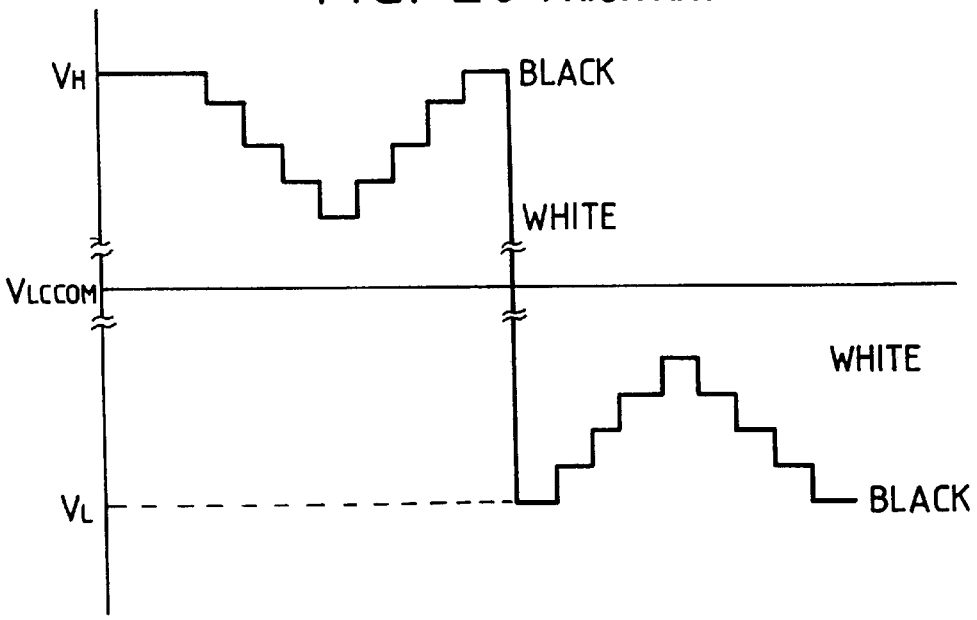
FIG. 20 PRIOR ART
FIG. 20 is an output waveform chart of the inverted signal generation circuit shown in FIG. 19.

When a display apparatus is constituted using this embodiment, the display apparatus can use substantially the same arrangement as in FIG. 12, except that the inverted signal generation circuit shown in FIG. 19 in the signal processing circuit 50 need only have an amplifier for outputting a positive polarity video signal of 5 V, and each of the memories in units of vertical electrodes ($d_1$, $d_2$, . . . ) of the line memory has the arrangement of the block 100 shown in FIG. 3.

Second Embodiment

Figure 5:
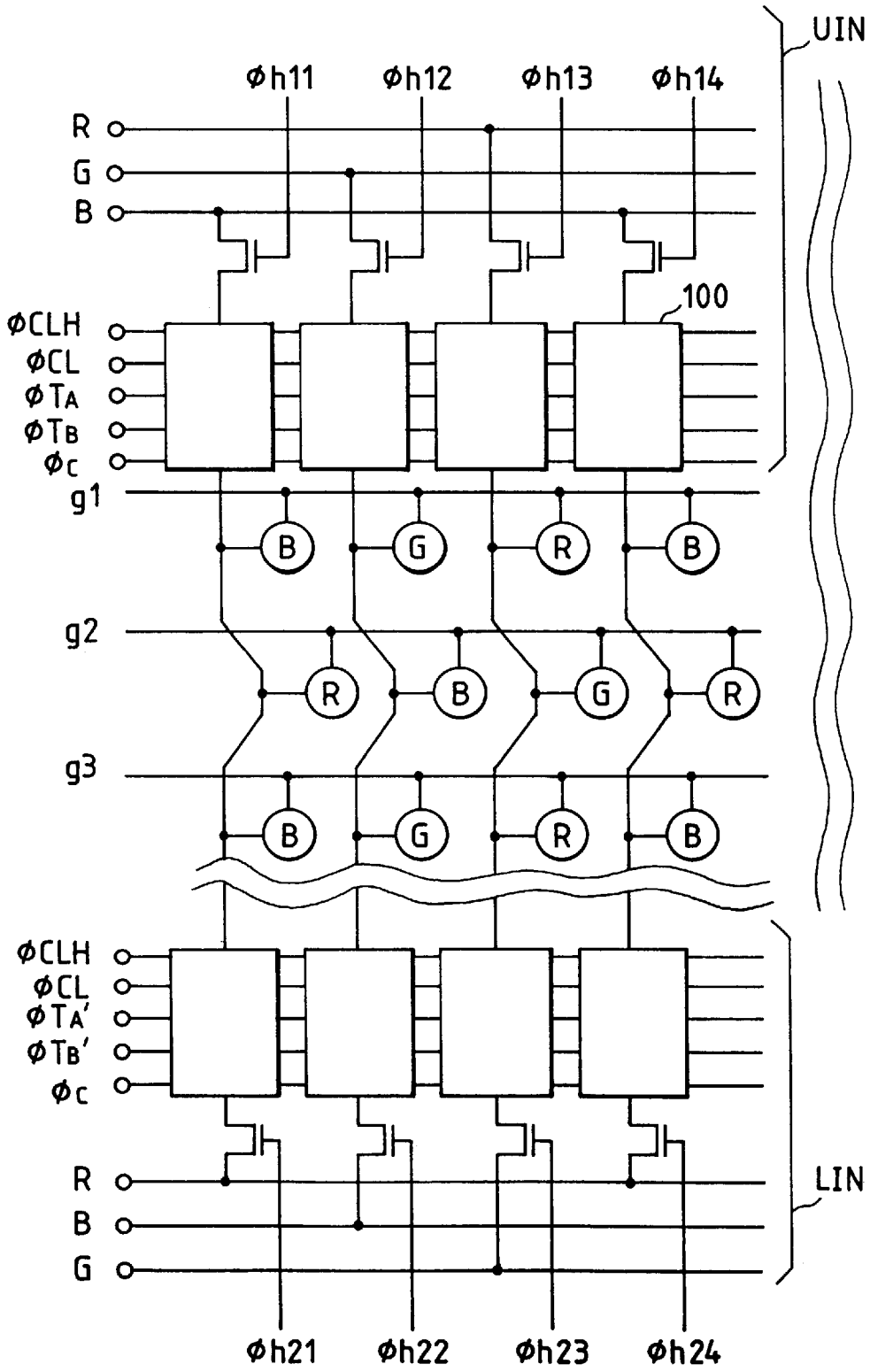
FIG. 5 is a circuit diagram of an inverted signal generation circuit according to the second embodiment of the present invention.
Figure 6:
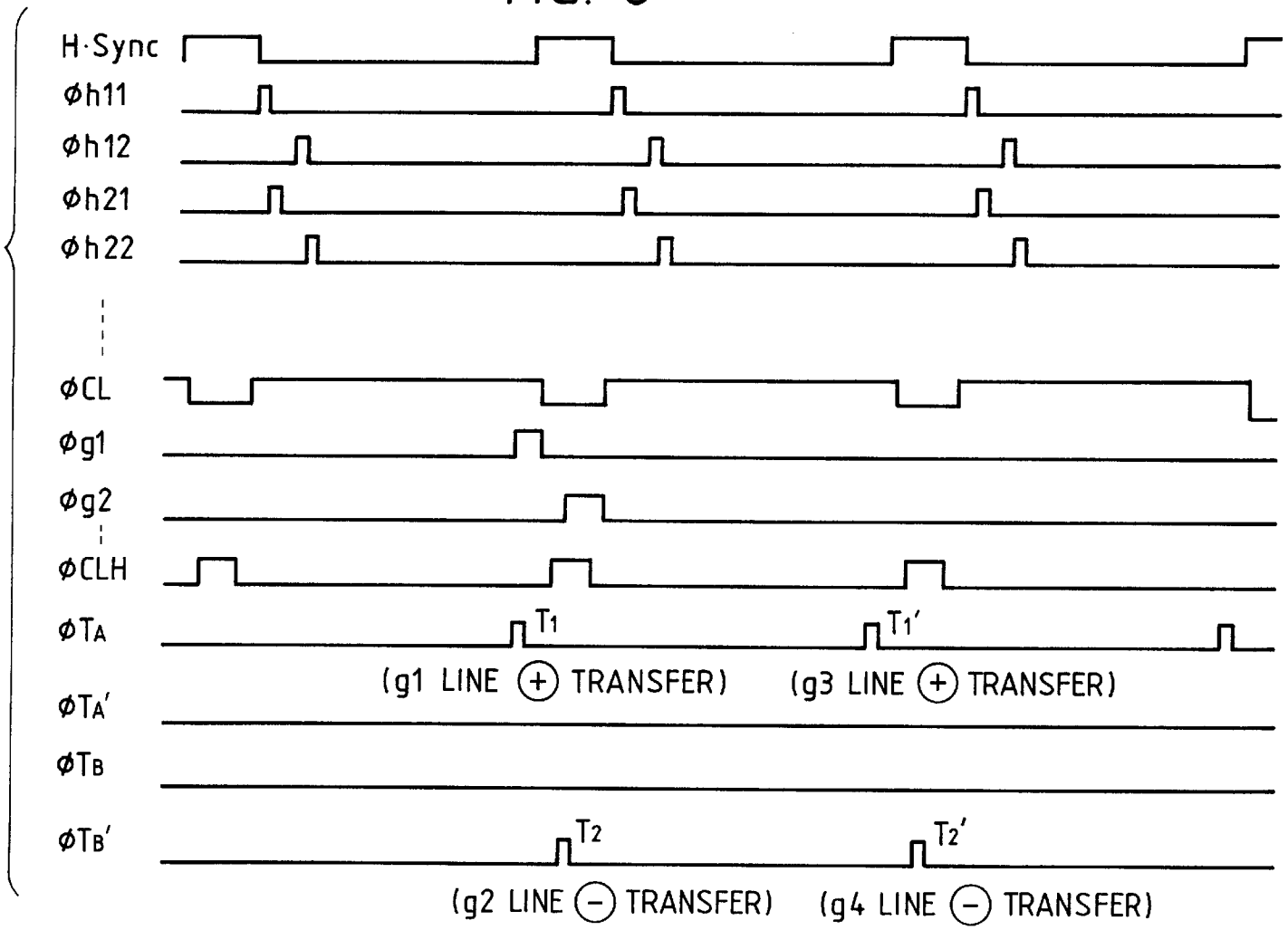
FIG. 6 is a timing chart of the respective signals in the circuit shown in FIG. 5.

FIG. 5 shows the arrangement of a signal inversion circuit according to the second embodiment of the present invention, and FIG. 6 is a timing chart of this circuit. In this embodiment, the present invention is applied to the two-system input method in which an input video signal is written in two pixel lines.

Referring to FIG. 5, an upper input system UIN samples signals corresponding to odd-numbered rows, and a lower input system LIN samples signals corresponding to even-numbered rows. The signals sampled by the two systems during an effective period are written in pixels, in such a manner that a positive polarity signal is written in pixels in a line $g_1$, during a period $T_1$ in FIG. 6, and an inverted signal is written in pixels in a line $g_2$ during a period $T_2$ in FIG. 6. Each block 100 has the same arrangement as that of the block 100 shown in FIG. 3. Similar signal write operations are performed in the subsequent scan periods.

More specifically, when a horizontal synchronization signal H·Sync is at high level, a pulse $\phi_{CL}$ goes low, and a pulse $\phi_{CLH}$ goes high, thus resetting the terminal a of the capacitance means to a potential $V_H$.

When the signal H·Sync is at low level, pulses $\phi h_{11}$ to $\phi h_{14}$ and pulses $\phi h_{21}$ to $\phi h_{24}$ are alternately applied in turn, thus sampling and holding the input signal at the terminal a of each capacitance means.

When the signal H·Sync goes high again, a row line $g_1$ is selected by a pulse $\phi_{g1}$, and a positive polarity information signal from the terminal a is supplied to the corresponding pixel in an odd-numbered row in response to a pulse $\phi T_A$. Then, the pulse $\phi_{CL}$ goes low, and the terminal b is set in a floating state. Thereafter, the pulse $\phi_{CLH}$ goes high, and the terminal a is clamped to the reference potential $V_H$. In this manner, when a pulse $\phi T_B'$ goes high, and a pulse $\phi_{g2}$ goes high, an inverted information signal from the terminal b is supplied to the corresponding pixel in an even-numbered row.

Thereafter, the same operation is performed while changing the row to be selected, and a 1-field period for sequentially scanning all the rows is completed.

In the next field, an inverted signal is written in odd-numbered rows, and a positive polarity signal is written in even-numbered rows. In this case, pulses $\phi T_A'$ and $\phi T_B$ are used for the transfer switches.

Third Embodiment

Figure 7:
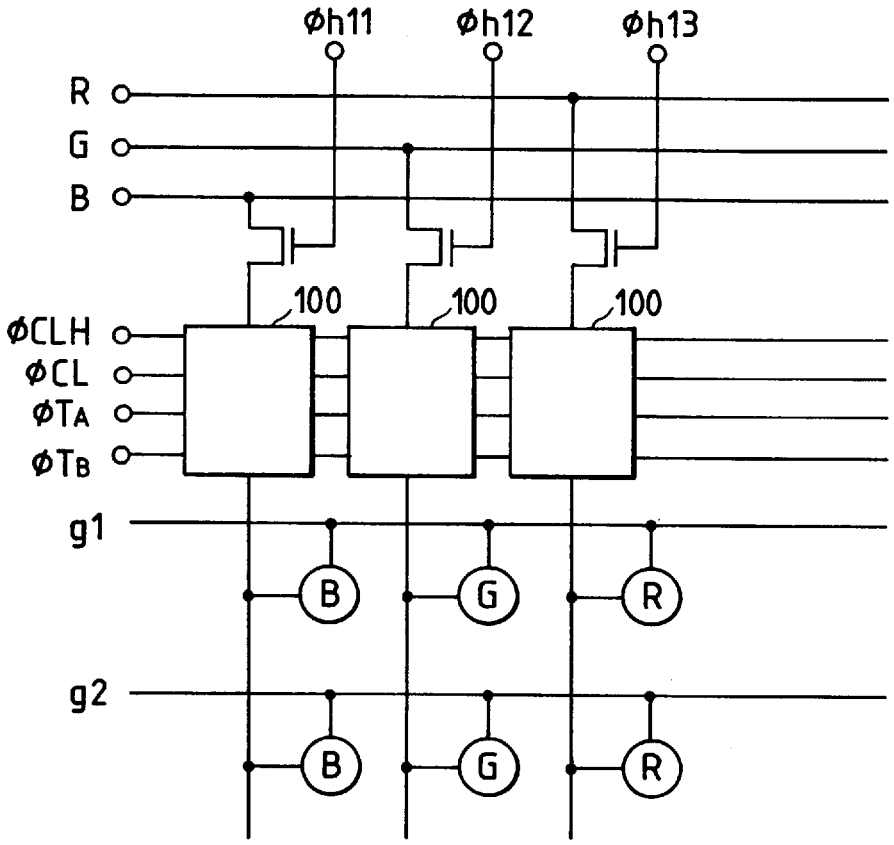
FIG. 7 is a circuit diagram of an inverted signal generation circuit according to the third embodiment of the present invention.
Figure 8:
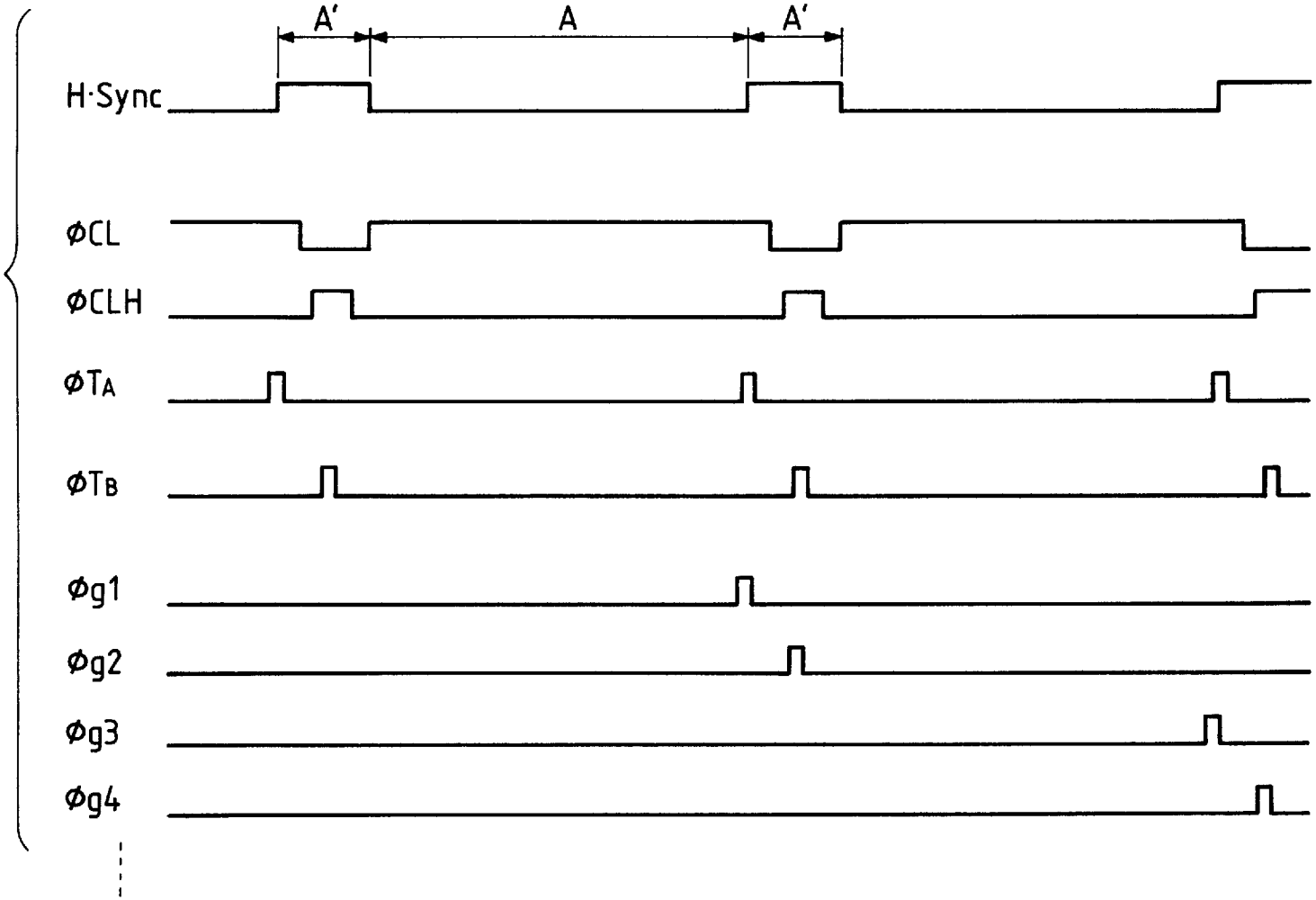
FIG. 8 is a timing chart of the respective signals in the circuit shown in FIG. 7.

FIG. 7 shows the arrangement of a signal inversion circuit according to the third embodiment of the present invention, and FIG. 8 is a timing chart of the circuit. The circuit of this embodiment is suitable for a display apparatus having a stripe layout of color pixels.

In the circuit shown in FIG. 7, an input pixel signal is sampled and held during an effective period A, and a positive polarity signal is written in a line $g_1$ during a horizontal blanking period. Then, an inverted signal is generated, and is written in a line $g_2$. In this embodiment, since only one system of memories are required, the arrangement is simple, and the chip area can be reduced. Therefore, this embodiment is suitable for a display apparatus having a large number of pixels. Each circuit 100 in FIG. 7 has the same arrangement as that of the block 100 in FIG. 3.

During a period A' in which a horizontal synchronization signal goes high, a pulse $\phi T_A$ goes high. At this time, although not shown in the timing chart in FIG. 8, a pulse $\phi_c$ preferably goes high to turn on the switch $Tr_3$, thereby resetting the terminal a. A pulse $\phi_{CL}$ goes low, and the terminal a is set in a floating state. Then, a pulse $\phi_{CLH}$ goes high, and the terminal a is reset.

During an effective period A, although not shown, pulses $\phi h_{11}$ to $\phi h_{13}$ go high to sequentially input an information signal to the corresponding terminal a. At this time, the terminal b is set at the reference potential since the pulse $\phi_{CL}$ is at high level.

During the next period A', since the pulse $\phi T_A$ goes high, and a pulse $\phi_{g1}$ goes high in synchronism with the pulse $\phi T_A$, the information signal is supplied from the terminal a to the corresponding pixel. Then, the pulse $\phi_{CL}$ goes low, and the terminal b is set in a floating state. Thereafter, the pulse $\phi_{CLH}$ goes high, and the terminal a is clamped at the potential $V_H$. Therefore, an inverted information signal is generated at the terminal b. Then, by changing pulses $\phi T_B$ and $\phi_{g2}$ to high level, the inverted signal at the terminal b is supplied to the corresponding pixel.

In this manner, all the rows are sequentially scanned to complete one field.

Fourth Embodiment

Figure 9:
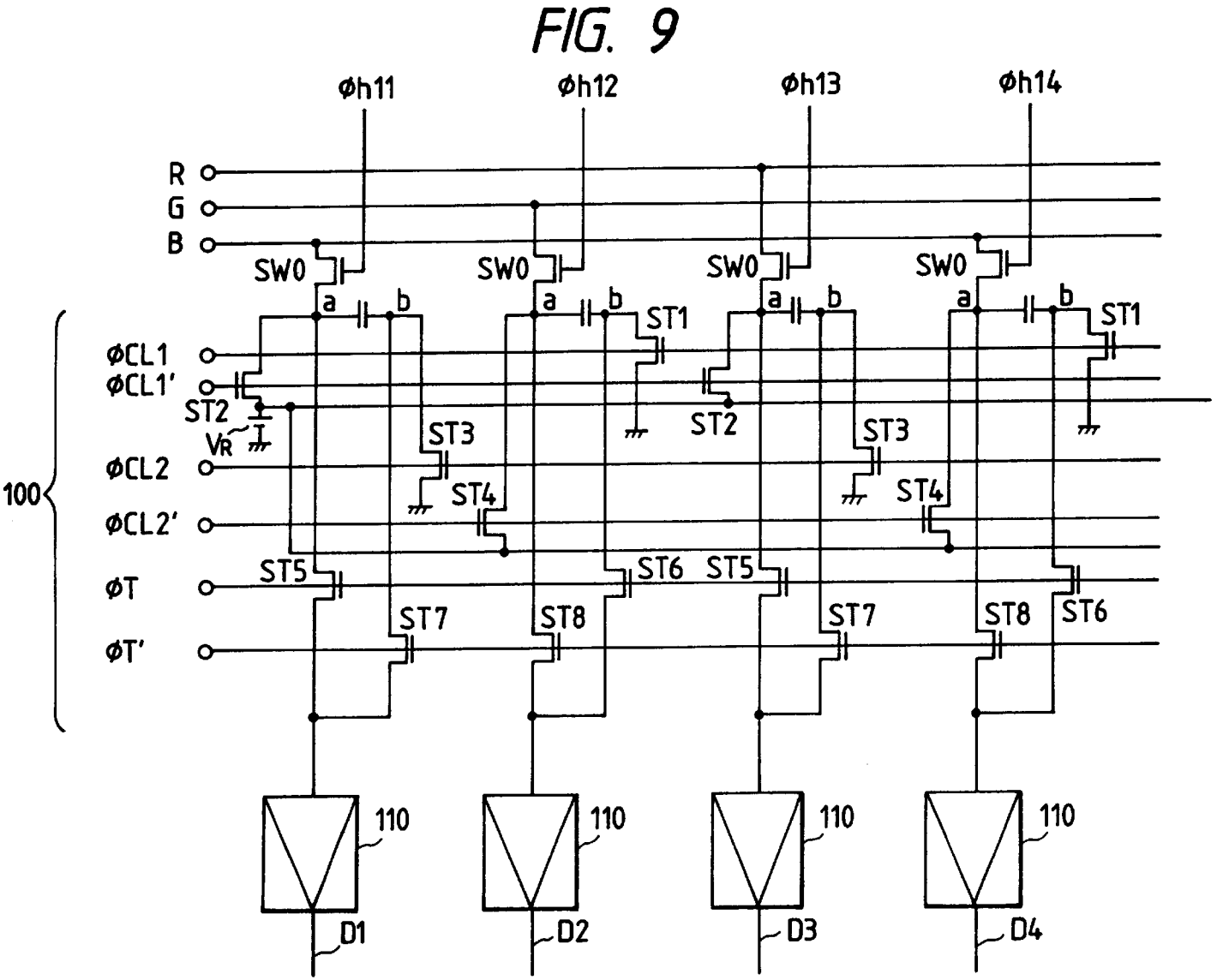
FIG. 9 is a circuit diagram of an inverted signal generation circuit according to the fourth embodiment of the present invention.
Figure 10:
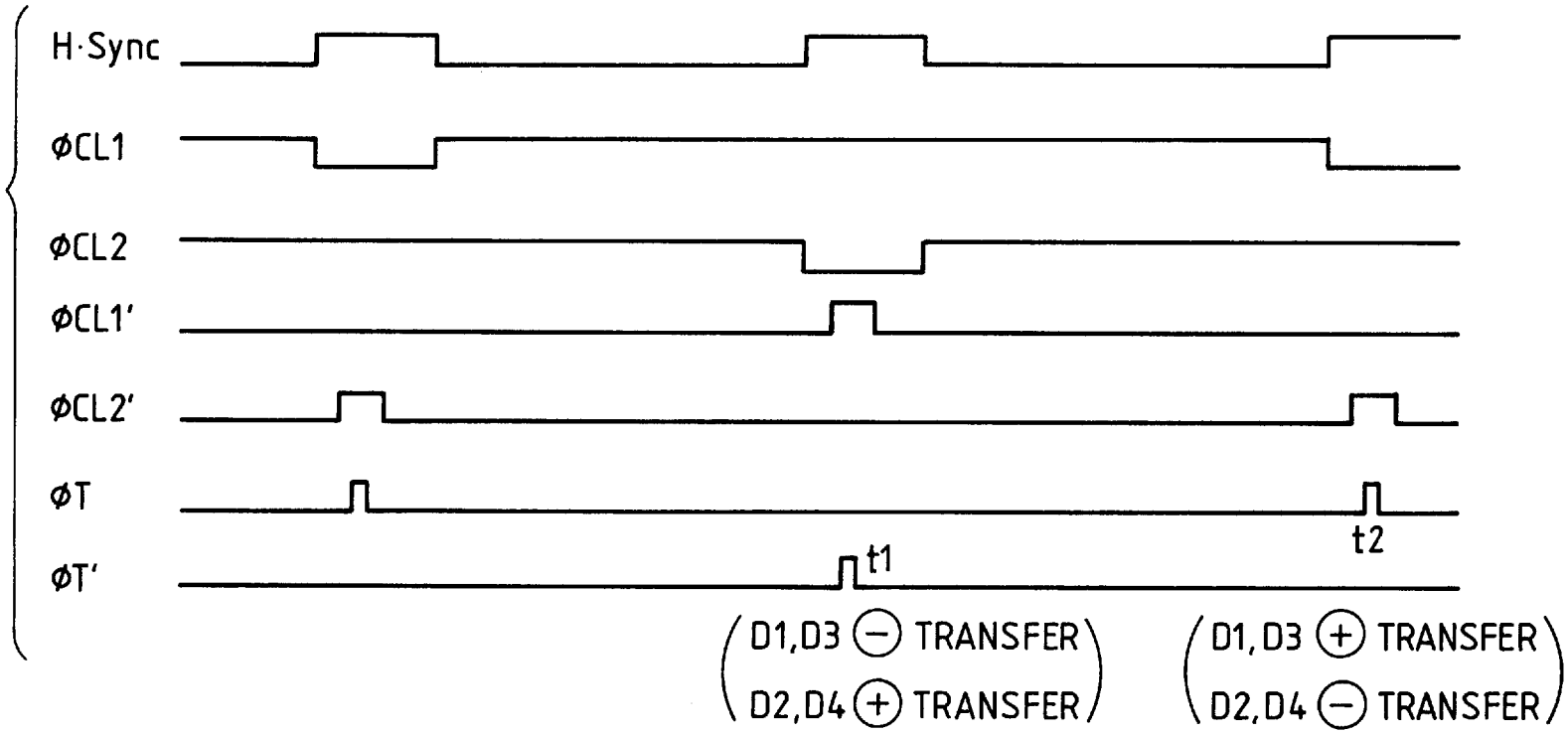
FIG. 10 is a timing chart of the respective signals in the circuit shown in FIG. 9.

FIG. 9 shows the arrangement of a signal inversion circuit according to the fourth embodiment of the present invention, and FIG. 10 is a timing chart of the circuit. The circuit of this embodiment copes with the dot inversion driving method.

The dot inversion method is a driving method for changing the signal polarity between adjacent pixels. The dot inversion driving method can eliminate flicker to a minimum level since the signal polarity is inverted in a minimum unit. However, conventionally, since the inversion period requires a very high frequency, it is difficult to realize this method.

In this embodiment, it is easy to perform inversion driving based on the memory capacitance in units of adjacent bits. Inversion of a signal is a change in voltage based on a small memory capacitance at a pulse width of several ps, and hence, the consumption power is very small. Since a signal is not inverted at a high frequency, no pulse noise is generated upon inversion. In FIG. 10, during a period $t_1$, a negative polarity signal is transferred to an odd-numbered column of a vertical data line, and a positive polarity signal is transferred to an even-numbered column. During a period $t_2$, the signal polarity is inverted.

The operation timing will be described in detail below.

When a horizontal synchronization signal H·Sync is at high level, a pulse $\phi_{CL1}$ goes low, and switches ST1 of transistors corresponding to signal lines D2 and D4 are turned off. Then, a pulse $\phi_{CL2}'$ goes high, and switches ST4 of transistors corresponding to the signal lines D2 and D4 are turned on, thereby resetting the terminals a to a potential $V_R$. Then, a pulse $\phi T$ goes high.

When the signal H·Sync goes low, the pulse $\phi_{CL1}$ goes high. During this period, sampling switches SWO are turned on at appropriate timings (not shown), thus inputting an information signal to the terminals a of capacitors.

When the signal H·Sync goes high again, a pulse $\phi_{CL2}$ goes low, and the terminals b of the capacitors corresponding to lines D1 and D3 are set in a floating state.

When a pulse $\phi_{CL1}'$ goes high, the terminals of the capacitors corresponding to the lines D1 and D3 are clamped to the reference potential $V_R$. Thus, an information signal input to the terminal a of each capacitor appears at the terminal b as an inverted signal. Thereafter, when a pulse $\phi T'$ goes high, switches ST7 and ST8 of transistors are turned on. Thus, the inverted signal is supplied from the terminals b of the capacitors corresponding to the lines D1 and D3 to amplifiers 110 via the switches ST7 of the transistors, and a non-inverted information signal is supplied from the terminals a of the capacitors corresponding to the lines D2 and D4 to the amplifiers 110.

When the signal H·Sync goes low again, an information signal is sampled. Thereafter, when the signal H·Sync goes high, the pulse $\phi_{CL1}$ goes low, and the pulse $\phi_{CL2}'$ goes high. Thus, an inverted signal is held at the terminals b of the capacitors corresponding to the lines D2 and D4, and a non-inverted signal is held at the terminals a of the capacitors corresponding to the lines D1 and D3. When the pulse $\phi T$ goes high and switches ST5 and ST6 of transistors are turned on, the inverted signal is transferred to the amplifiers 110 of the lines D2 and D4 via the switches ST6, and the non-inverted information signal is transferred to the amplifiers 110 of the lines D1 and D3 via the switches ST5.

In this manner, inverted and non-inverted signals are supplied to two adjacent lines, and an information signal which is inverted in units of adjacent bits in an identical scan row is supplied to pixels.

Fifth Embodiment

Figure 11:
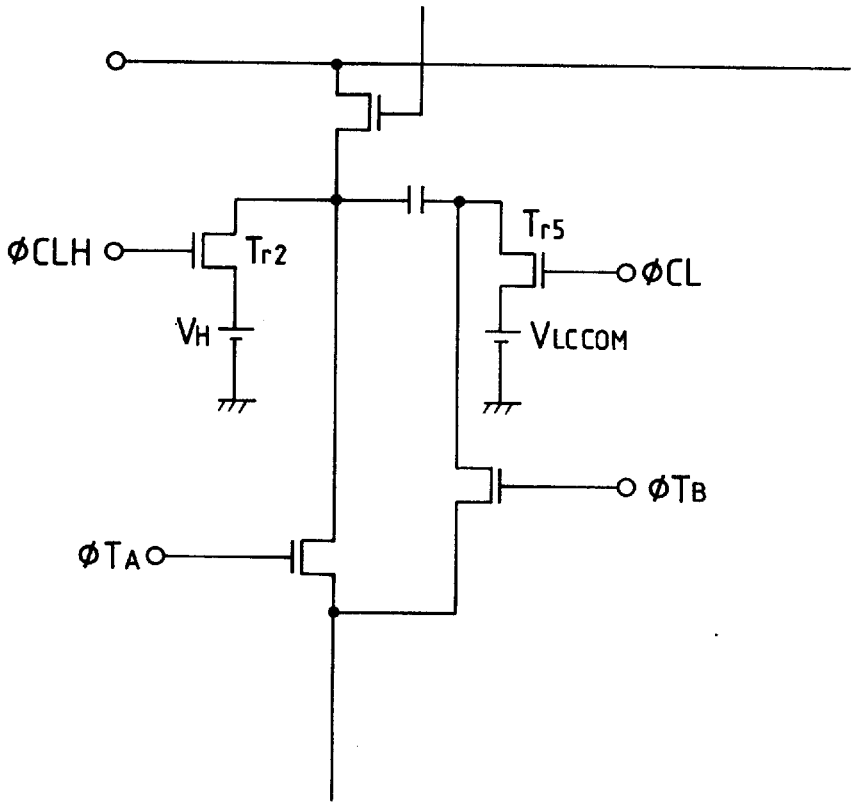
FIG. 11 is a circuit diagram of an inverted signal generation circuit for common inverted driving according to the fifth embodiment of the present invention.

FIG. 11 shows the arrangement of a signal inversion circuit according to the fifth embodiment of the present invention.

In this embodiment, the reset potential of the reset transistor $Tr_5$ is set to be $V_{LCCOM}$ which is equal to the common electrode potential in the circuit shown in FIG. 3.

In the circuit shown in FIG. 3, since the signal (inverted signal) voltage in the circuit changes like $U_2 \rightarrow -U_2 \rightarrow V_H - U_2$, $V_H + U_2$ is required as the withstand voltage of a transistor. However, in the circuit shown in FIG. 11, since the signal voltage changes like $V_{LCCOM} - U_2 \rightarrow V_{LCCOM} + U_2$, the withstand voltage of a transistor can be $2U_2$.

Since a low withstand voltage can be used, the transistor size can be reduced.

Sixth Embodiment

FIG. 12 shows the signal waveforms obtained when the reference potential of the transistor $Tr_2$ shown in FIG. 11 is set to be $V_{LCCOM}$ in place of $V_H$. This signal waveform is suitable for common inversion driving. The common electrode potential in common inversion can be changed as indicated by $V_{LCCOM}$ in FIG. 12.

When the reset potential of the transistor $Tr_5$ is set to be $U_2/2$, the withstand voltage of the transistor can be further reduced.

As described above, the above embodiment is characterized by inverting an input video signal and converting a potential. When a normal video signal is amplified and input, an inverted signal can be generated by a line memory in the display apparatus, thus improving versatility of the display apparatus.

Seventh Embodiment

Figure 13:
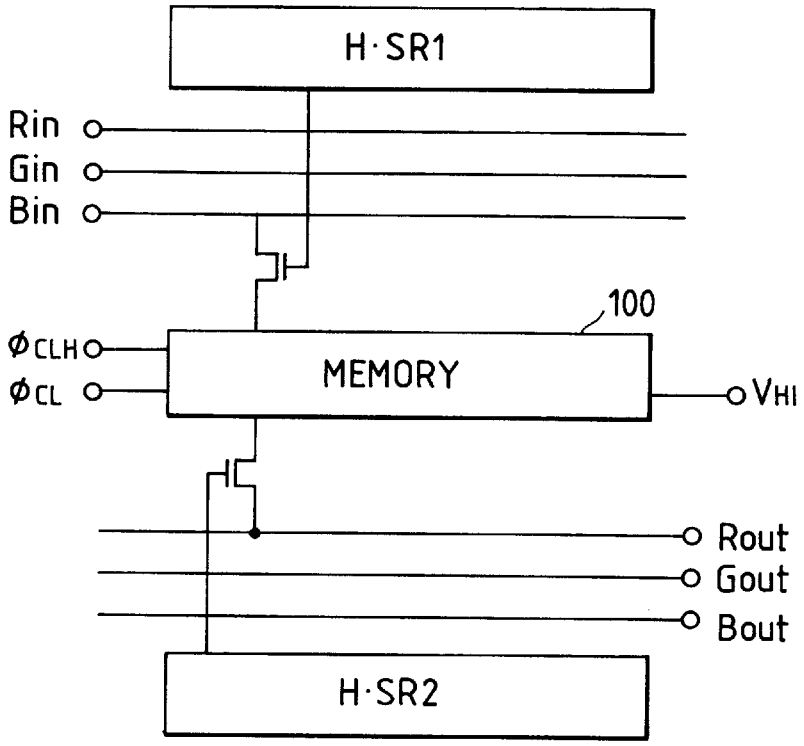
FIG. 13 is a circuit diagram of an analog memory IC according to the sixth embodiment of the present invention.

FIG. 13 shows the above-mentioned inverted signal generation circuit integrated on an external IC. Using this IC, an analog serial signal is temporarily stored in a line memory 100, and an inverted signal shown in FIG. 4 or 10 is generated when the stored signal is read out. The generated signal can be output as a serial signal again, and can be input to the display apparatus. The arrangement shown in FIG. 13 is effective for a line memory having both an analog memory function and an inverted signal generation function. If this IC is utilized in the double-speed driving method, a display apparatus having no line memory can be non-interlace-driven by an output signal from the IC, and a high-resolution display free from flicker can be realized.

As described above, according to the embodiments of the present invention, a display apparatus can be driven by low-voltage peripheral circuits. Furthermore, the above-mentioned circuit can easily cope with a display apparatus having a large number of pixels. In addition, since the signal level can be easily adjusted, a high-quality image can be displayed since generation of noise appearing as vertical or horizontal stripes can be prevented and flicker is not conspicuous.

Eighth Embodiment

Figure 14:
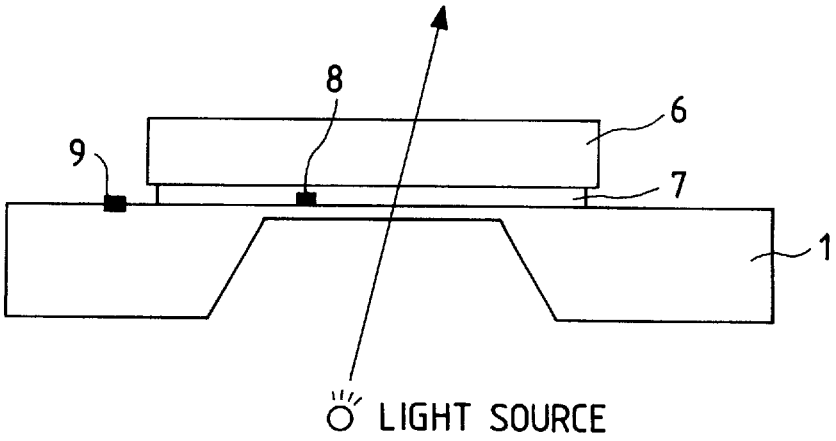
FIG. 14 is a sectional view showing a display apparatus according to the eighth embodiment of the present invention.

FIG. 14 is a sectional view of a display apparatus according to this embodiment. A substrate 1 uses a silicon wafer, and a portion of the substrate under a display pixel unit is removed to form a light transmission portion.

A liquid crystal layer 7 and a transparent substrate 6 are formed in turn on the substrate 1.

Figure 15:
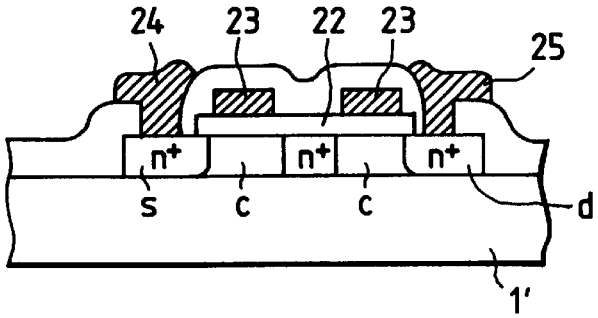
FIG. 15 is a sectional view showing a transistor in a pixel unit shown in FIG. 14.

The pixel unit has a transistor 8. FIG. 15 is an enlarged view of the transistor 8.

Figure 16:
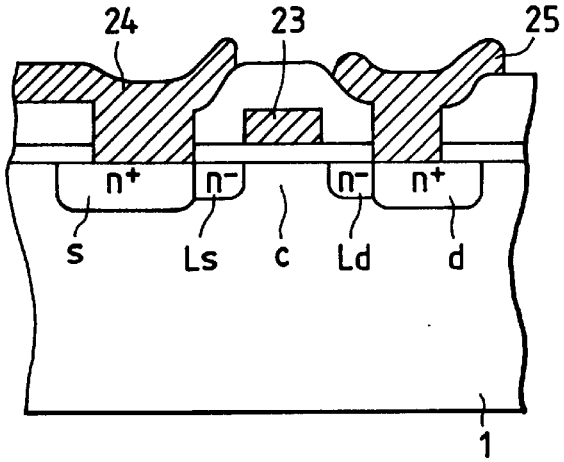
FIG. 16 is a sectional view showing a transistor in an inverted signal generation circuit shown in FIG. 14.
Figure 18:
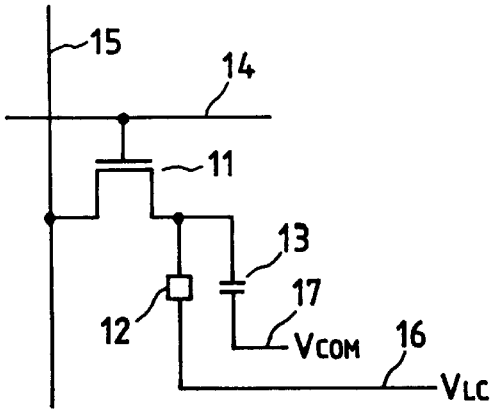
FIG. 18 is a circuit diagram showing the arrangement of a unit pixel in a display pixel unit shown in FIG. 17.
Figure 17:
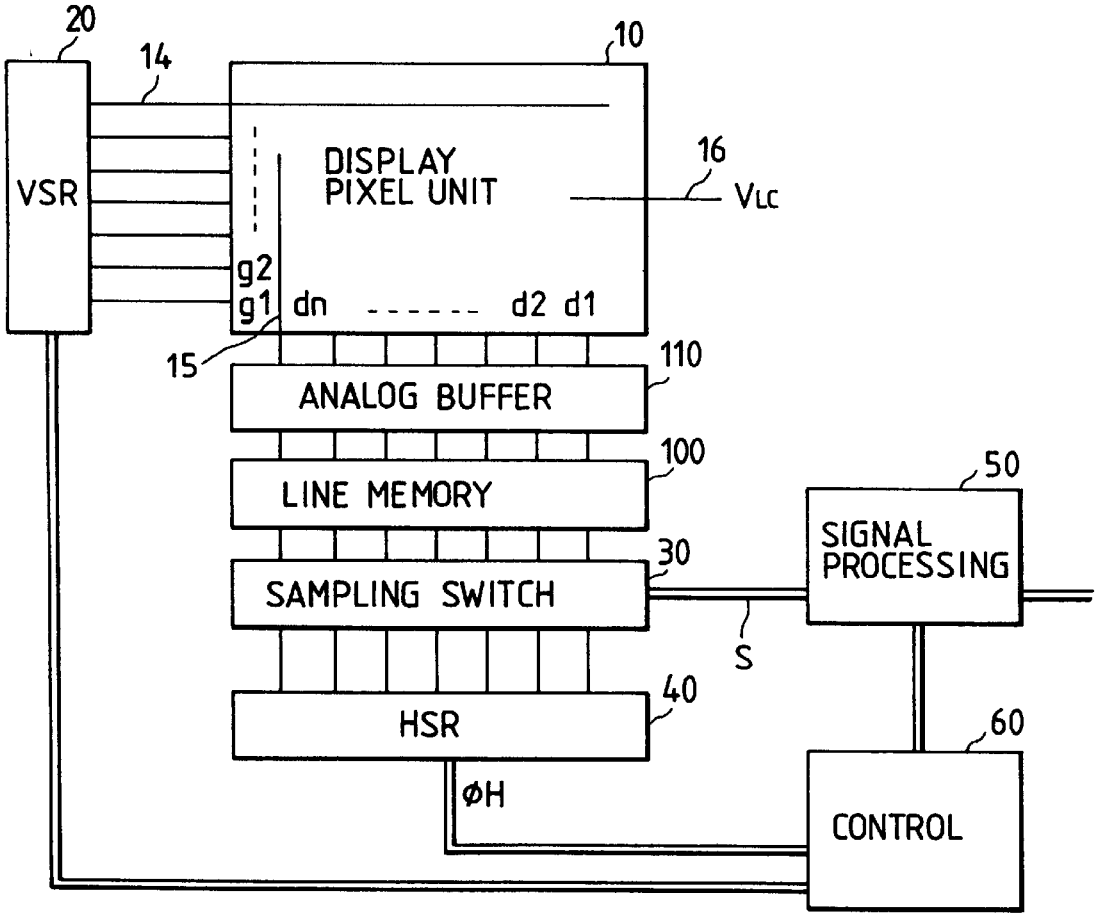
FIG. 17 PRIOR ART
FIG. 17 is a block diagram showing the arrangement of a conventional liquid crystal display apparatus.

A transistor 9 constitutes an inverted signal generation circuit of the present invention. FIG. 16 is an enlarged view of the transistor 9.

FIG. 15 shows a dual gate type thin-film transistor having two gates 23. A source s, a drain d, and channels c are formed in a silicon island-shaped region. The transistor includes a gate insulating film 22, a source electrode 24, and a drain electrode 25. Note that 1' indicates a transparent portion of the substrate.

FIG. 16 shows a transistor having an LDD structure. This transistor is formed in the surface of a silicon wafer. This transistor has lightly doped regions Ld and Ls.

The display apparatus of each of the above-mentioned first to seventh embodiments is preferably manufactured using the transistors of the eighth embodiment.

As described above, a signal input to the first terminal of a capacitor can be converted into an inverted signal generated at the second terminal side by setting the second terminal in a floating state, and holding the first terminal at a reference potential. Therefore, according to the present invention, since an inverted signal can be generated by a simple circuit which can be driven at a low voltage, a low-cost circuit can be realized. This circuit contributes to size and cost reductions of the display apparatus since it can be easily integrated on the substrate of a display device. The circuit of the present invention can be easily applied to a display device having a large number of pixels. Furthermore, since the voltage level of an information signal can be easily adjusted, vertical or horizontal stripe-shaped noise and flicker appearing on the display screen can be suppressed.

What is claimed is:

1. A signal generation circuit for driving a display device, comprising:

capacitance means having a first terminal serving as an input terminal of an information signal, and a second terminal;

first switch means for connecting the second terminal of said capacitance means to a first reference potential source;

second switch means for connecting the first terminal to a second reference potential source;

first signal read-out means for reading out a signal from the first terminal while the second terminal is connected to the first reference potential source; and second signal read-out means for reading out a signal from the second terminal while the first terminal is connected to the second reference potential source.

2. A circuit according to claim 1, wherein said first and second signal read-out means alternately read out signals appearing at the first and second terminals at an arbitrary period.

3. A circuit according to claim 1, wherein a plurality of units each including said capacitance means and said first and second read-out means are arranged in correspondence with a plurality of sources of video signals.

4. A circuit according to claim 1, wherein a signal is alternately read out by said first and second signal read-out means based on a signal stored in said capacitance means.

5. A display apparatus comprising a signal generation circuit of claim 1, wherein a pixel signal read out by said first and second signal read-out means of said signal generation circuit is transferred to pixels of a display device, and a display corresponding to the pixel signal is made on the display device.

6. A display apparatus having an active matrix substrate on which a circuit of claim 1 is formed.

7. A signal generation circuit for driving a display device, comprising:

capacitance means having a first terminal and a second terminal;

a first signal read-out means for reading out a signal from the first terminal based on a signal stored in said capacitance means and a second signal read-out means for reading out an inverted signal from the second terminal based on said signal stored in said capacitance means.

8. A circuit according to claim 7, wherein the voltage of said inverted signal is shifted.

9. A circuit according to claim 7, wherein at least one of said first signal read-out means and said second signal read-out means comprises a buffer amplifier.

* * * * *

UNITED STATES PATENT AND TRADEMARK OFFICE

CERTIFICATE OF CORRECTION

PATENT NO. : 5,883,608

DATED : March 16, 1999

INVENTOR(S) : SEIJI HASHIMOTO

It is certified that error appears in the above-identified patent and that said Letters Patent is hereby corrected as shown below:

On the title page:

AT [56] REFERENCES CITED

FOREIGN PATENT DOCUMENTS

"4371997" should read --4-371997--.

COLUMN 7

Line 59, "$g_1$," should read --$g_1$--.

COLUMN 9

Line 9, "ps," should read --$\mu$s,--.

Signed and Sealed this

Fourteenth Day of December, 1999

Q. Todd Dickinson

Q. TODD DICKINSON

Acting Commissioner of Patents and Trademarks

Attest:

Attesting Officer